US012752967B2

(12) United States Patent
Johnson

(10) Patent No.: US 12,752,967 B2
(45) Date of Patent: Oct. 6, 2026

(54) BOTTLE TIE

(71) Applicant: David Johnson, Miami, FL (US)

(72) Inventor: David Johnson, Miami, FL (US)

( * ) Notice: Subject to any disclaimer, the term of this patent is extended or adjusted under 35 U.S.C. 154(b) by 99 days.

(21) Appl. No.: 18/808,714

(22) Filed: Aug. 19, 2024

(65) Prior Publication Data

US 2026/0048901 A1 Feb. 19, 2026

(51) Int. Cl.
*B65D 23/06* (2006.01)
*B65D 23/08* (2006.01)

(52) U.S. Cl.
CPC ..... *B65D 23/065* (2013.01); *B65D 23/0842* (2013.01); *B65D 2203/02* (2013.01)

(58) Field of Classification Search
CPC ..... B65D 47/40; B65D 23/06; B65D 23/065; B65D 23/0842; B65D 2203/02; B65D 51/245; B65D 77/36; B65D 5/4275; B65D 21/0208; Y10S 5/922; Y10S 52/13; Y10S 128/15
See application file for complete search history.

(56) References Cited

U.S. PATENT DOCUMENTS 1,837,495 A * 12/1931 Shaw ..... G09F 3/04 40/310
2,199,037 A * 4/1940 Borden ..... G09F 3/04 40/310
2,200,616 A * 5/1940 Carey ..... G09F 3/04 40/310
3,063,590 A * 11/1962 Hopkins ..... B65D 23/065 D19/1
5,188,877 A * 2/1993 Magaro ..... B65D 81/3886 428/80
6,228,459 B1 * 5/2001 Bujalski ..... B65D 23/065 428/80
7,192,632 B2 * 3/2007 Heldibridle ..... B32B 5/24 428/80
8,347,532 B1 * 1/2013 Johnson ..... G09F 23/06 40/310
9,624,001 B1 * 4/2017 Hill ..... B65D 23/065
2001/0030208 A1 * 10/2001 Iggulden ..... B65D 23/065 428/354
2005/0199579 A1 * 9/2005 Novak ..... B65D 23/065 215/392
2008/0185360 A1 * 8/2008 Zak ..... B65D 23/065 215/392
2011/0011487 A1 * 1/2011 Barnes ..... B65D 23/065 141/1
2014/0014610 A1 * 1/2014 Steinberg ..... B65D 23/06 215/41
2021/0047077 A1 * 2/2021 Fenwick ..... G09F 3/02
2023/0039739 A1 * 2/2023 Samokhvalov .... A47G 23/0241
2023/0389735 A1 * 12/2023 Lyons ..... A47G 19/2227

* cited by examiner

*Primary Examiner* — Kareen K Thomas
(74) *Attorney, Agent, or Firm* — David W Barman

(57) ABSTRACT

The present invention is a bottle tie having a triangular main body having a horizontal edge, a first diagonal edge, a second diagonal edge, a first corner, a second corner and a third corner, wherein said main body has a planer outer surface and a planer inner surface with a hook and loop fastener system and elastic sewn between said planer outer surface and planer, inner surface, parallel and adjacent to horizontal edge.

1 Claim, 5 Drawing Sheets

BOTTLE TIE

BACKGROUND OF THE INVENTION

Persons familiar with food and drink presentation will attest that when pouring drinks from a bottle having a bottleneck that is narrower than the base of the bottle, often, spills and drips occur. Many people are familiar with the commonly practiced serving protocol where a cloth is wrapped completely around a bottle while drinks are being poured. While this does assist in absorbing drips from the outside of the bottle, it is bulky and obscures the bottle label. There is a need for an article that will help absorb drips on the outside of a bottle and not obscure the label. The present invention addresses this need.

SUMMARY OF THE INVENTION

In one embodiment, the present invention is constructed and arranged to hug the shape of every wine/champagne bottle.

In one embodiment, the present invention is constructed and arranged for it to never impinge on the label of the wine/champagne bottle.

In one embodiment, the present invention is constructed and arranged sticks to the wine/champagne bottle once condensation ensues.

In one embodiment, the present invention is constructed and arranged with hook and loop fasteners that allows the invention to fit any size bottle.

In one embodiment, the present invention is constructed and arranged with an elasticized neck hole that allows for a superior snug on any wine/champagne bottle.

In one embodiment, the present invention is constructed and arranged free space on the center of the outer surface of the invention is usable for disposing indicia as a marketing, advertising and promoting tool for any business.

As understood, the invention acts as a buffer and cleaning utensil which will be used by sommeliers instead of a large napkin to prevent drippage and spillage on table/tablecloth. This replaces conventional wine rings.

In one embodiment, the present invention is a bottle tie comprising:

- a triangular main body having a horizontal edge, a first diagonal edge, a second diagonal edge, a first corner, a second corner and a third corner, wherein said main body has a planer outer surface and a planer inner surface;
- a hook and loop fastener system position on said first corner and said second corner of said main body;
- elastic sewn between said planer outer surface and planer, inner surface, parallel and adjacent to horizontal edge.

In one embodiment, the present invention has a first indicia disposed thereon.

In one embodiment, the present invention has a second indicia disposed thereon.

In one embodiment, the present invention has a first indicia and a second indicia disposed thereon.

In one embodiment, the present invention is constructed and arranged to secure about a bottle neck of a bottle.

In one embodiment, the present invention is constructed and arranged to secure about a bottle neck of a wine, champaign or liquor bottle.

In one embodiment, the present invention is constructed and arranged to secure about a bottle neck of a bottle in a manner so as not to secure an existing label on said bottle.

In one embodiment, the present invention is constructed and arranged to secure about a bottle neck of a bottle in a manner so as not to secure an existing label on said bottle.

In one embodiment, the present invention is a bottle tie comprising:

- a triangular main body having a horizontal edge, a first diagonal edge, a second diagonal edge, a first corner, a second corner and a third corner, wherein said main body has a planer outer surface and a planer inner surface;
- a fastener system position on said first corner and said second corner of said main body;
- elastic sewn between said planer outer surface and planer, inner surface, parallel and adjacent to horizontal edge.

In one embodiment, the present invention the fastener is a pair of magnets, a pair of snaps, or button and button hole.

In one embodiment, the present invention is a bottle tie consisting of:

- a triangular main body having a horizontal edge, a first diagonal edge, a second diagonal edge, a first corner, a second corner and a third corner, wherein said main body has a planer outer surface and a planer inner surface;
- a hook and loop fastener system position on said first corner and said second corner of said main body;
- elastic sewn between said planer outer surface and planer, inner surface, parallel and adjacent to horizontal edge; wherein said main body includes a first indicia disposed on said planer outer surface and a second indicia disposed on said planer inner surface constructed and arranged to secure about a bottle neck of a bottle in a manner so as not to secure an existing label on said bottle.

DETAILED DESCRIPTION OF THE INVENTION

Figure 5:
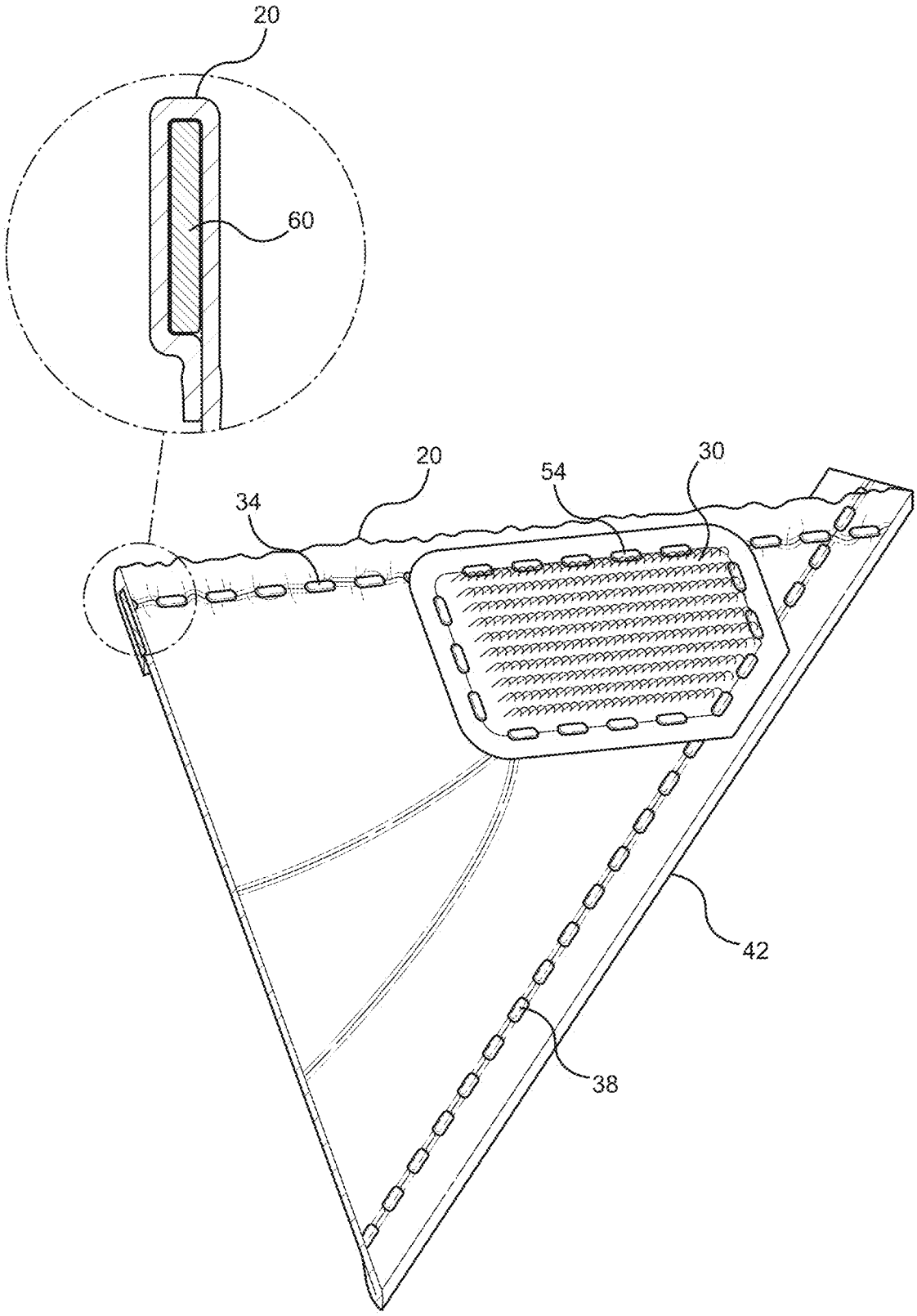
FIG. 5 is a partial cross-section view along section lines 6-6 from FIG. 3 showing elastic embedded in the horizontal edge.

As generally understood by the accompanying drawings, the present invention is bottle tie. Main body 10 is positioned around bottleneck 12, which is proximate to top of bottle 14. As generally understood from the drawings, main body 10 is triangular. Bottle main sidewall 16 emanates upward from bottle base 18. As generally understood, bottle label 19 is positioned as shown. Main body 10 is formed with horizontal edge 20, first corner 22, second corner 24, and third corner 26. Outer planer surface 28 optionally has indicia 50 disposed their on. First indicia 50 is particularly suited for display of a commercial brand name or logo. However, first indicia 50 is not limited to any particular or specific display. It can be a brand-name, logo, personal name, event name, or any other visual indicia without limitation. Main body 10 is secured about the circumference of a bottle utilizing hook and loop fasteners as is known. Loop number 30 is constructed and arranged to interact with hook member 43 in a hook and loop fastening arrangement as is known. Additionally, secondary indicia 32 is disposed on outer planer surface 28. Again, as with first indicia 50, second 32 can be words, logos, or any visual initial without limit. Second indicia 32 has about a perimeter second indicia stitching 52. Main body tend further includes horizontal stitching 34 diagonal stitching 36 and second diagonal stitching 38. First diagonal stitching 36 is parallel and adjacent to first diagonal edge 40. Second diagonal stitching 38 is parallel and adjacent to second diagonal edge 42. Loop member 30 is secured to outer planer surface 28 utilizing stitching 54. Hook member 43 is secured to airplane or surface 40 utilizing stitching 52. As seen in the partial cross-section demonstrated and FIG. 5, elastic 60 runs along an interior cavity, parallel and adjacent to first horizontal edge 20.

Figure 1:
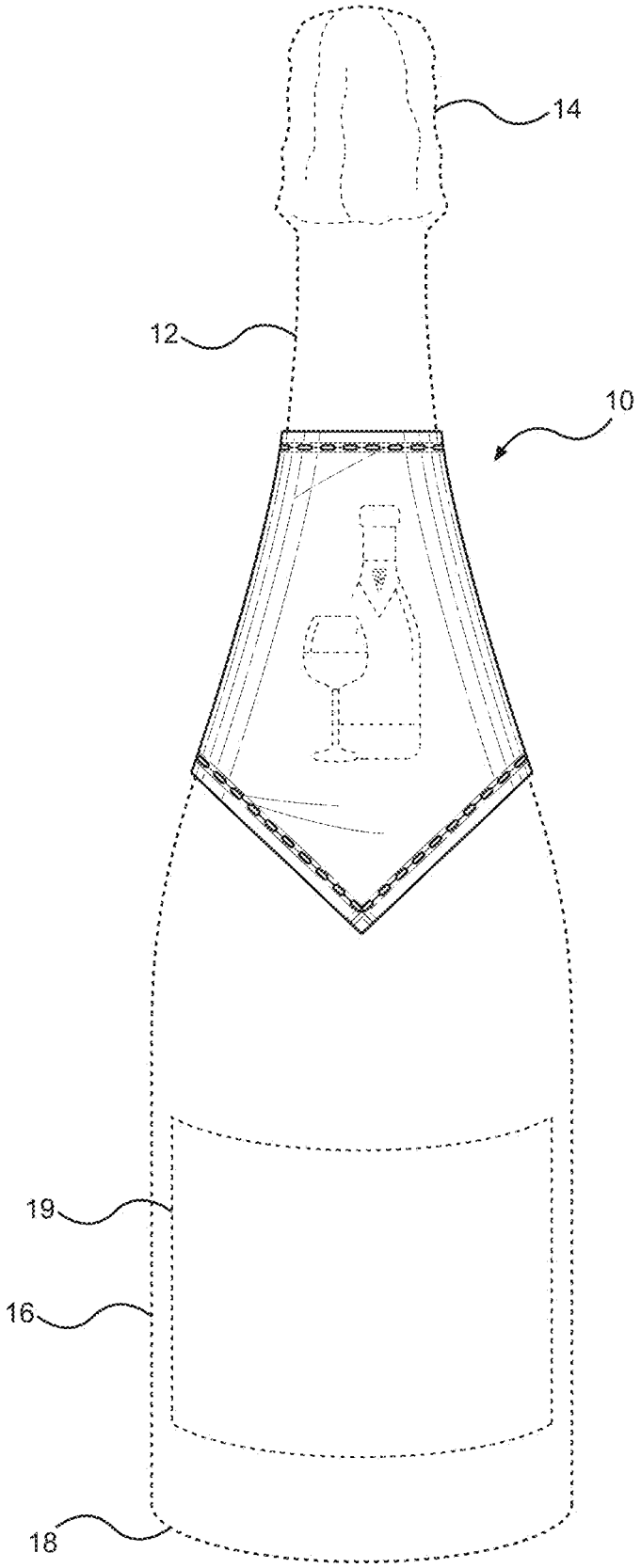
FIG. 1 is front view of the present invention in an environment of use.
Figure 2:
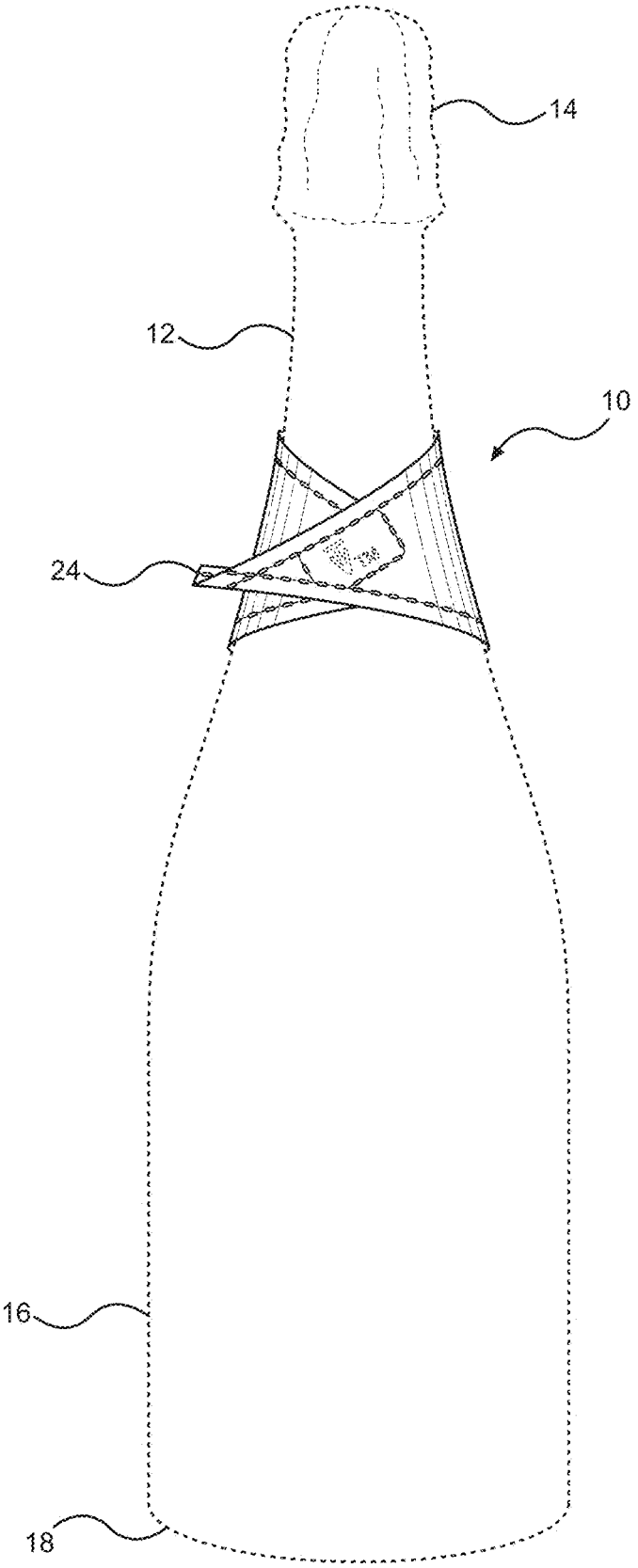
FIG. 2 is back view of the present invention in an environment of use.
Figure 3:
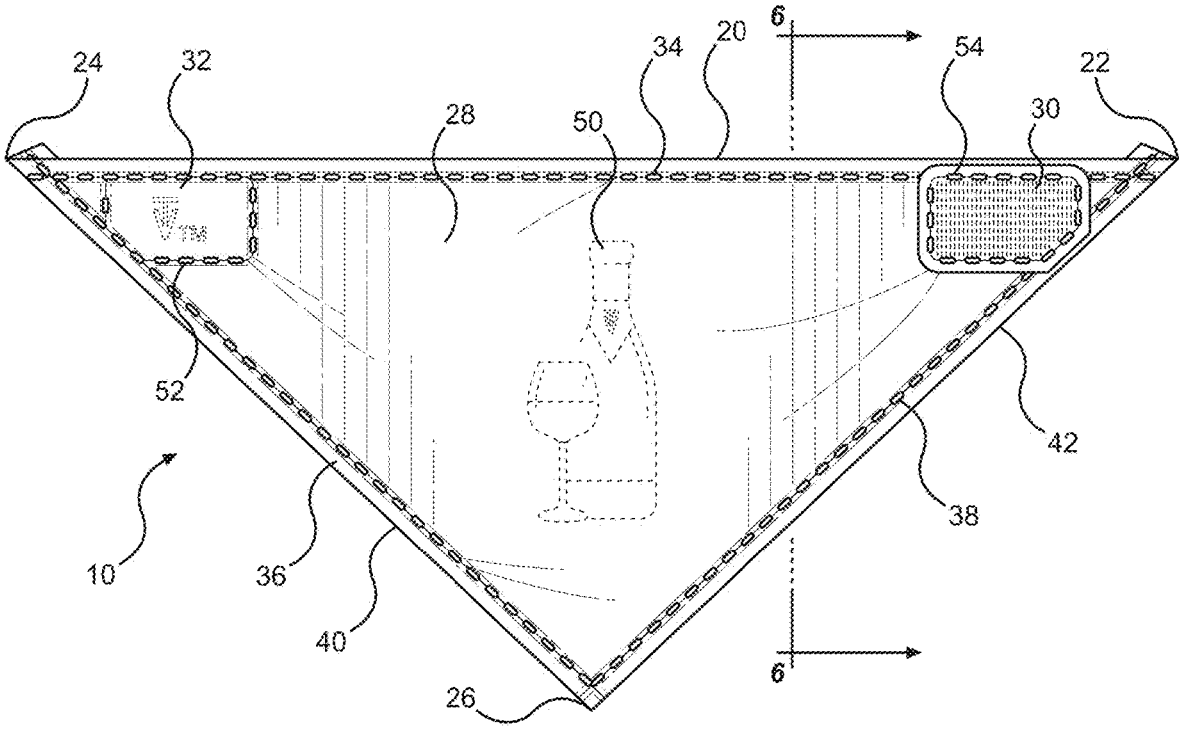
FIG. 3 is front plan view according to one embodiment of the present invention.
Figure 4:
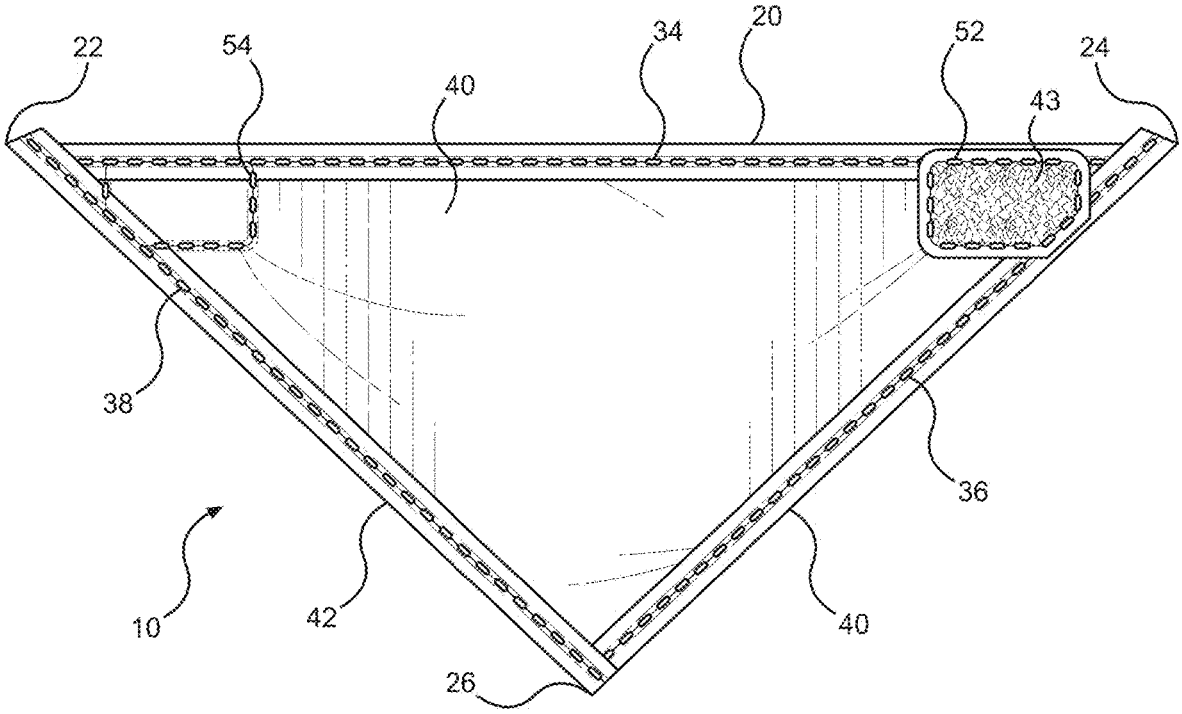
FIG. 4 is back plan view according to one embodiment of the present invention.

In use, a user will grab main body 10 position it around the circumference of bottleneck 12 and secure second corner 24 onto first corner 22 by mating loop 30 with hook 43 in a hook and loop securing arrangement. The particular configuration of the present invention contemplates, providing a useful article with visual indicia in a manner that does not obscure label 19 as demonstrated in FIG. 1.

Figure 6:
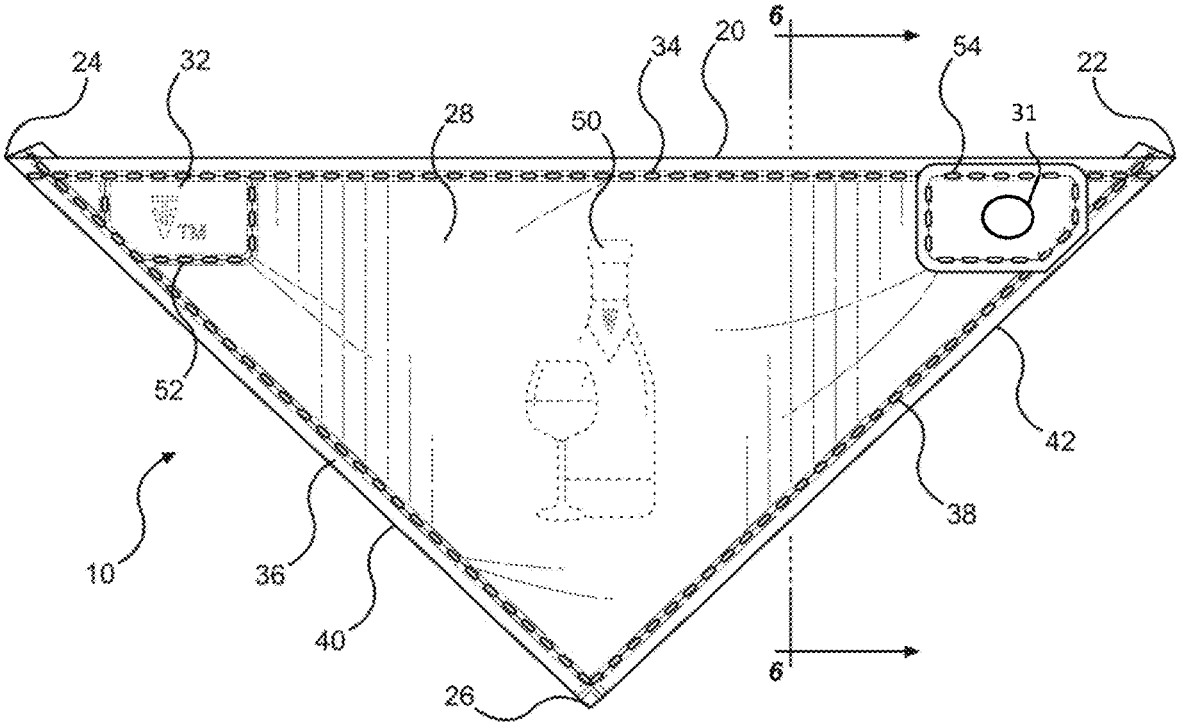
FIG. 6 is front plan view according to one embodiment of the present invention.
Figure 7:
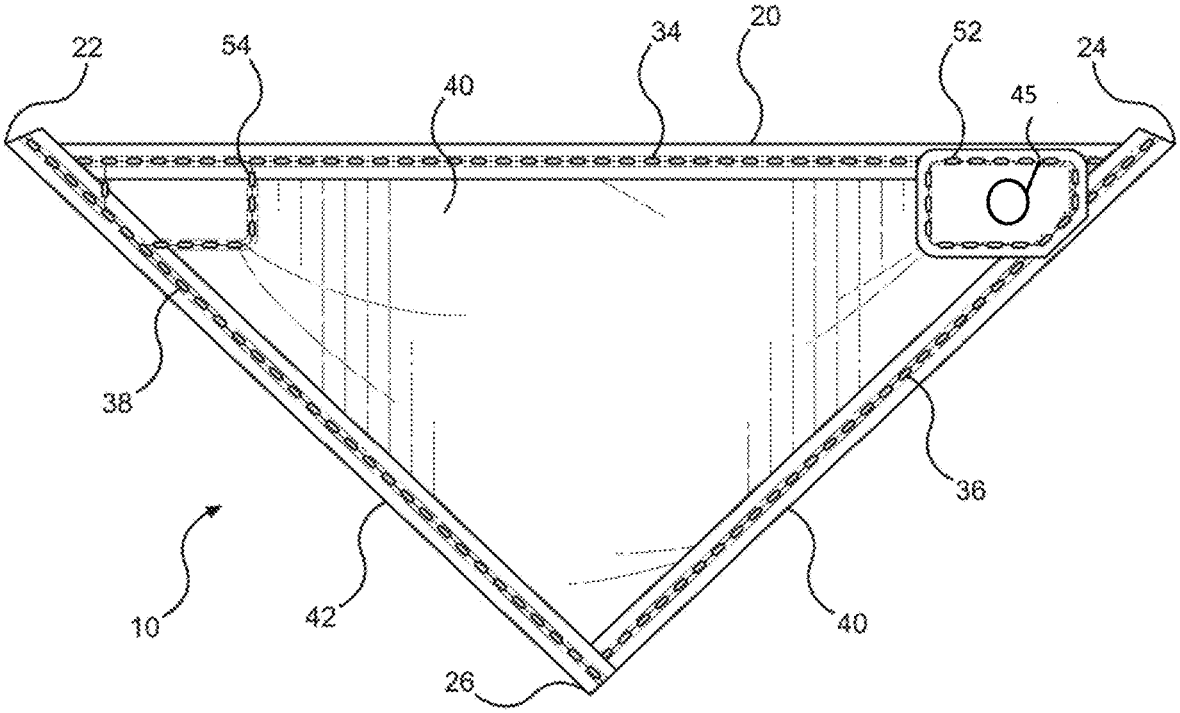
FIG. 7 is back plan view according to one embodiment of the present invention.

In another embodiment as demonstrated in FIGS. 6 and 7, first closure member 31 and second closure member 45 are utilized. It is contemplated that each of first closure member 31 and second closure member 45 include, but are not limited to, snaps, buttons, magnets, button/button hole, and the like. In these embodiments the fasteners would be contracture to provide for the securing of main body 10 into position.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

The invention claimed is:

1. A bottle tie consisting of:

a triangular main body having a horizontal edge, a first diagonal edge, a second diagonal edge, a first corner, a second corner and a third corner, wherein said main body has a planer outer surface and a planer inner surface;

a hook and loop fastener system position on said first corner and said second corner of said main body;

said bottle tie comprises elastic, sewn between said planer outer surface and planer inner surface parallel and adjacent to said horizontal edge; wherein said main body includes a first indicia disposed on said planer outer surface and a second indicia disposed on said planer inner surface constructed and arranged to secure about a bottle neck of a bottle in a manner so as not to secure an existing label on said bottle.

* * * * *